US010423111B2

(12) United States Patent
Tanaka

(10) Patent No.: US 10,423,111 B2
(45) Date of Patent: Sep. 24, 2019

(54) IMAGE FORMING APPARATUS EFFECTING CORRECTION OF IMAGE FORMATION CHARACTERISTICS

(71) Applicant: CANON KABUSHIKI KAISHA, Tokyo (JP)

(72) Inventor: Sumito Tanaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/277,106

(22) Filed: Sep. 27, 2016

(65) Prior Publication Data

US 2017/0090375 A1 Mar. 30, 2017

(30) Foreign Application Priority Data

Sep. 29, 2015 (JP) ..... 2015-190844

(51) Int. Cl.
*G03G 15/08* (2006.01)
*G03G 15/00* (2006.01)

(52) U.S. Cl.
CPC ..... *G03G 15/5062* (2013.01); *G03G 15/0865* (2013.01)

(58) Field of Classification Search
None
See application file for complete search history.

(56) References Cited

U.S. PATENT DOCUMENTS 6,418,281 B1 7/2002 Ohki
7,701,610 B2 4/2010 Mikami
8,749,849 B2 6/2014 Tanaka
9,223,278 B2 12/2015 Fujiwara et al.
9,606,489 B2 3/2017 Takaya et al.
2005/0219602 A1* 10/2005 Mikami ..... G03G 15/0856 358/1.14
2009/0297182 A1* 12/2009 Kinukawa ..... G03G 15/0266 399/43
2013/0016371 A1 1/2013 Tanaka
2013/0155422 A1 6/2013 Kuo et al.
2013/0251387 A1 9/2013 Tanaka
2014/0255052 A1 9/2014 Fujiwara et al.
(Continued)

FOREIGN PATENT DOCUMENTS

JP 59116768 A * 7/1984 ..... G03G 15/065
JP 04255881 A * 9/1992
(Continued)

OTHER PUBLICATIONS

Machine translation of Takashima (1992).*
Machine translation of Tanaka (2013).*

*Primary Examiner* — Sevan A Aydin
(74) *Attorney, Agent, or Firm* — Venable LLP

(57) ABSTRACT

An image forming apparatus includes a measuring unit configured to measure a stopping time period in which rotation of a developer carrying member is stopped; a correcting unit configured to control an image forming unit to form a pattern image, control a detecting unit to detect the pattern image, and correct an image formation condition of the image forming unit based on a detection result of the detecting unit; and a correcting unit configured to correct a correction amount of the image formation condition, which is corrected by the correcting unit, based on the stopping time period measured by the measuring unit.

8 Claims, 12 Drawing Sheets

(56) References Cited

U.S. PATENT DOCUMENTS

| | | | | |
|---|---|---|---|---|
| 2016/0033917 | A1* | 2/2016 | Kikuchi | G03G 15/556 399/66 |
| 2016/0266533 | A1* | 9/2016 | Takaya | G03G 15/556 |

FOREIGN PATENT DOCUMENTS

| | | | | | |
|---|---|---|---|---|---|
| JP | 2004085707 | A | * | 3/2004 | |
| JP | 2005-169686 | A | | 6/2005 | |
| JP | 2005-227317 | A | | 8/2005 | |
| JP | 2009-058739 | A | | 3/2009 | |
| JP | 2009053397 | A | * | 3/2009 | |
| JP | 2010-072258 | A | | 4/2010 | |
| JP | 2013-024887 | A | | 2/2013 | |
| JP | 2013195788 | A | * | 9/2013 | G03G 21/203 |
| JP | 2014-174230 | A | | 9/2014 | |
| JP | 2015-210426 | A | | 11/2015 | |
| JP | 2016-170208 | A | | 9/2016 | |

* cited by examiner

IMAGE FORMING APPARATUS EFFECTING CORRECTION OF IMAGE FORMATION CHARACTERISTICS

BACKGROUND OF THE INVENTION

Field of the Invention

The present invention relates to an image forming apparatus.

Description of the Related Art

As a method of correcting an image processing characteristic, in particular, a gradation characteristic in an image forming apparatus, e.g., a color multifunctional peripheral or a color printer, the following method is known.

First, the image forming apparatus is activated. After a warm-up operation is ended, a pattern image is formed on an image bearing member. Then, the pattern image is transferred onto a sheet. Then, the density of the transferred pattern image is read, and an operation of a gamma correction circuit or the like, which is configured to determine image formation conditions, is adjusted based on the read density information. The method described above is known as a method of stabilizing a quality of an image to be formed (image quality).

FIG. 12 is a flow chart for illustrating an example of a control procedure when the gradation characteristic of the image forming apparatus is adjusted.

In FIG. 12, first, a control switch of the image forming apparatus is turned on to activate the apparatus (Step S201). The image forming apparatus forms a pattern image (Step S202). The image forming apparatus reads the pattern image to acquire its density (Step S203). The image forming apparatus stores a laser output level and the acquired density in association with each other in a memory (Step S204). The image forming apparatus generates, based on the information stored in the memory, a conversion condition (gradation correction condition) for converting a signal value of image data in order to set the gradation characteristic of the image forming apparatus to an ideal gradation characteristic (target gradation characteristic) (Step S205). The gradation correction condition corresponds to, for example, a γ lookup table (hereinafter referred to as "γ-LUT"). The gradation characteristic of the image forming apparatus is adjusted based on the content of the γ-LUT. Such a function is generally referred to as "gradation correction".

Further, in an image forming apparatus described in U.S. Pat. No. 6,418,281, there is described a method of performing the gradation correction without using a sheet.

In this apparatus, during an image forming operation, a pattern image is formed in a non-image region on the image bearing member. Based on the detection result of reflection light from the pattern image, image formation conditions including a γ-LUT and an exposure amount of a laser beam for adjusting the maximum density of the image are adjusted.

However, even if the density of the image can be corrected to a target value after the gradation correction is performed, when there is a large change between before and after the correction, a user may falsely determine that color deviation is occurring, that is, the image quality is not stable. In particular, when the image forming apparatus automatically performs the gradation correction, it is highly possible that the user falsely recognizes that the color has deviated. As a result, there remains a problem in that the gradation correction performed for stabilizing the image quality is negatively recognized as color deviation by the user.

The present invention has a primary object to provide an image forming apparatus capable of suppressing user's false recognition of regarding gradation correction as a color deviation.

SUMMARY OF THE INVENTION

An image forming apparatus according to the present invention includes: a developer carrying member configured to carry developer and to rotate; an image forming unit configured to form an image on an image bearing member with developer carried by the developer carrying member; a detecting unit configured to detect a pattern image formed on the image bearing member; a measuring unit configured to measure a stopping time period in which rotation of the developer carrying member is stopped; a correcting unit configured to: determine a feedback condition based on the stopping time period measured by the measuring unit, control the image forming unit to form the pattern image, control the detecting unit to detect the pattern image, and correct an image formation condition of the image forming unit based on the feedback condition and a detection result of the detecting unit.

Further features of the present invention will become apparent from the following description of exemplary embodiments (with reference to the attached drawings).

DESCRIPTION OF THE EMBODIMENTS

Now, the present invention is described with reference to the drawings while exemplifying a case where the present invention is applied to an electrophotographic image forming apparatus. A relative arrangement of respective components described below, numerical expressions, numerical values, and the like are not intended to limit the scope of the present invention.

Figure 1:
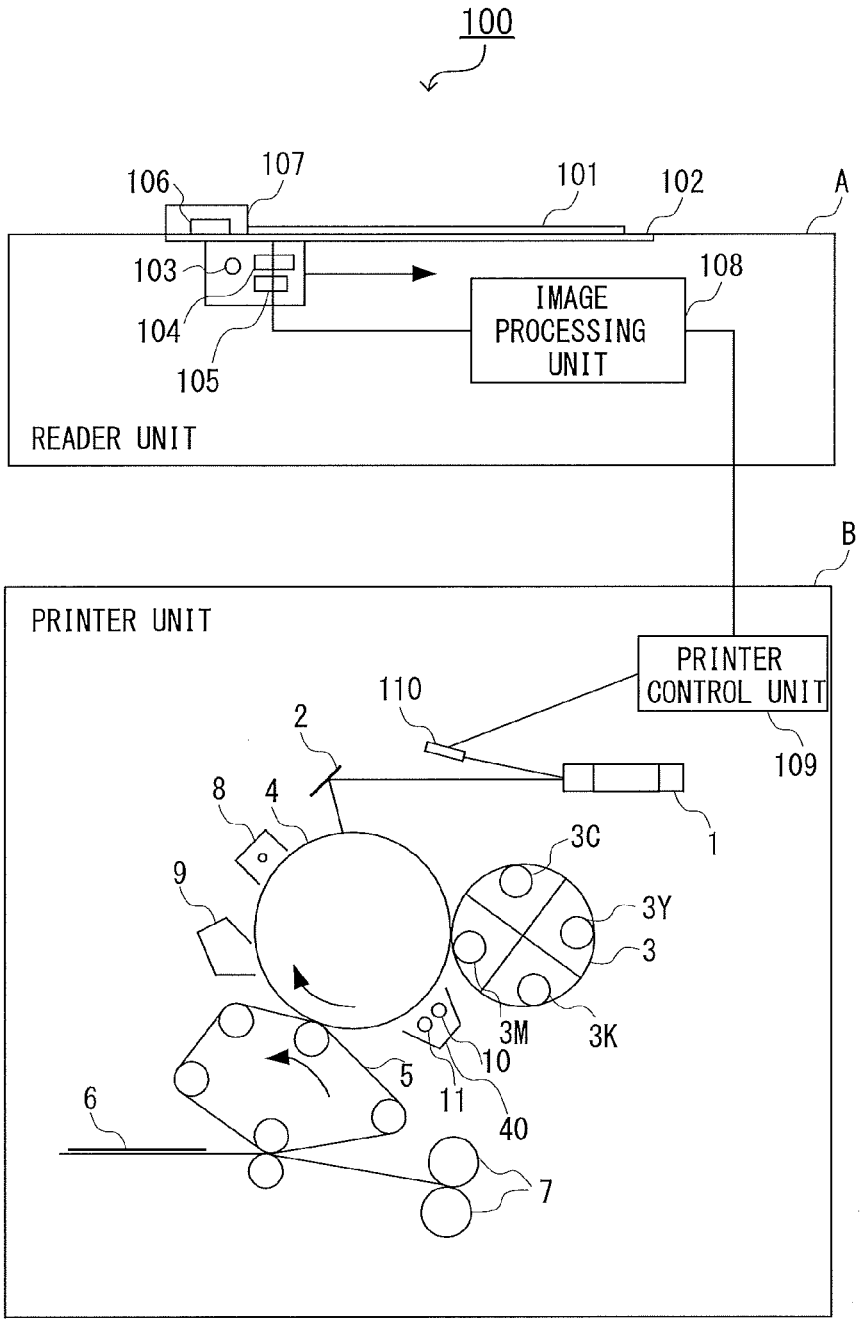
FIG. 1 is a schematic vertical sectional view for illustrating an example of a configuration of an image forming apparatus according to a first embodiment of the present invention.

FIG. 1 is a schematic vertical sectional view for illustrating an example of a configuration of an image forming apparatus according to a first embodiment.

An image forming apparatus 100 includes a reader unit A configured to read an image formed on an original, and a printer unit B configured to print the image read by the reader unit A. As described above, the reader unit A functions as an original reading unit, and the printer unit B functions as a forming unit configured to form an image.

The reader unit A includes an original table glass 102, a light source 103, an optical system 104, a charge coupled device (CCD) sensor 105, a reference white plate 106, a butting member 107, and an image processing unit 108. The reader unit A further includes an operation panel 507, a central processing unit (CPU) 508, and a memory 509 to be described later.

An original 101 placed on the original table glass 102 of the reader unit A has its reading surface irradiated with light from the light source 103. The reflection light from the reading surface is imaged on the CCD sensor 105 via the optical system 104. The CCD sensor 105 includes, for example, CCD line sensor groups arrayed in three rows. Further, the CCD sensor 105 is configured to generate color component signals of red, green, or blue for each line sensor. A reading optical system unit having this configuration is configured to scan the original 101 in a direction indicated by the arrow in FIG. 1 to convert the result of reading the original 101 into an electrical signal data string (image data) for each line.

The reference white plate 106 is a reference plate to be read for determining the white level of the CCD sensor 105, and is used for shading in a thrust direction of the CCD sensor 105 or the like. The butting member 107 is used for preventing the original 101 from being obliquely placed on the original table glass 102.

An image signal acquired via the CCD sensor 105 is subjected to image processing by the image processing unit 108. The image data subjected to the processing is transmitted to a printer control unit 109 of the printer unit B. Now, the summary of the functional configurations of the printer unit B is described.

The printer unit B includes a rotary developing device 3 including developing devices of respective color components. The rotary developing device 3 functions as a developing unit. Further, the rotary developing device 3 is rotatably supported by a rotation supporting device (not shown). The developing devices of the rotary developing device 3 are sequentially opposed to a photosensitive drum 4 and are configured to perform development with toner of respective colors. A photosensitive layer is formed on the surface of the photosensitive drum 4. The photosensitive layer of the photosensitive drum 4 functions as a photosensitive member.

The photosensitive drum 4 serving as an example of an image bearing member is rotationally driven by a driving force transmitted from a driving mechanism (not shown) at a predetermined angular velocity toward a direction indicated by the arrow in FIG. 1. A charging device 8 is configured to uniformly charge the surface of the photosensitive drum 4.

Then, a laser beam is scanned for exposure via an exposure device whose ON/OFF is controlled based on the image data of the first color (for example, magenta). With this, an electrostatic latent image of the first color is formed on the photosensitive drum 4. As described above, the electrostatic latent image is formed on the image bearing member. The electrostatic latent image is developed by a developing sleeve 3M carrying the first-color magenta toner. The visualized first-color toner image is primarily transferred onto an intermediate transfer member 5.

This transfer process is similarly repeated for toner of other colors (yellow, cyan, and black), and the images of the respective colors are transferred onto the intermediate transfer member 5 so as to overlap with each other. The images formed on the intermediate transfer member 5 are transferred onto recording material 6 (for example, a sheet) serving as recording media fed from a sheet feeding unit. An image is formed on the recording media as described above. Then, the recording material 6 is subjected to a fixing process by a fixing device 7, and is then delivered outside of the apparatus. An image is formed through such a flow. Now, details of the respective constituent devices are described.

The fixing device 7 is configured to heat and fix the toner image formed on the recording material 6. The fixing device 7 includes a fixing roller configured to apply heat to the recording material 6, and a pressure roller configured to pressure-contact the recording material 6 to the fixing roller.

The charging device 8 is, for example, a corona charging device, and is applied with a bias voltage to negatively charge the surface of the photosensitive drum 4 uniformly. A laser driver included in the printer control unit 109 and a laser light source 110 are configured to convert the image data received from the reader unit A into laser light, and to emit the laser light. The emitted laser light is reflected by a polygon mirror 1 and a mirror 2, to thereby be radiated on the uniformly charged photosensitive drum 4.

A cleaning device 9 is configured to remove residue toner on the photosensitive drum 4 after the image visualized by the developing device is transferred onto the recording material on a transfer drum. Waste toner is accumulated in a cleaning container, and the cleaning container is replaced at a stage at which the container becomes full.

Further, the developing devices having toner of respective colors accommodated therein are removably mounted to the rotary developing device 3. For example, when the magenta toner developing device is stopped at a position opposed to the photosensitive drum 4, a gap with a minute interval (about 400 μm) is secured between the developing sleeve 3M in the magenta toner developing device and the surface of the photosensitive drum 4.

After the developing operation of each color is ended, the rotary developing device 3 is moved to a home position. The home position of the rotary developing device 3 refers to a position at which the developing sleeves 3M, 3C, 3Y, and 3K do not abut against the surface of the photosensitive drum 4. This is for preventing the toner in the rotary developing device 3 from unintentionally adhering to the surface of the photosensitive drum. Further, toner can be prevented from mixing into developing devices for toner of other colors accommodated in the rotary developing device 3.

A photosensor 40 includes a light emitting diode (LED) light source 10 (having a dominant wavelength of about 960 nm) and a photodiode (PD) 11, and is arranged so as to be opposed to the surface of the photosensitive drum 4. The LED light source 10 is configured to radiate light to a pattern image formed on the photosensitive drum 4. The photodiode 11 is configured to detect the reflection light amount from the pattern image. Further, the image forming apparatus 100 includes a time measuring device configured to measure a non-rotation time period of the developing sleeve. The image forming apparatus 100 further includes a temperature and humidity sensor (not shown), to thereby monitor environmental information on an inside of the apparatus. Next, the summary of image processing to be performed by the reader unit A is described with reference to FIG. 2.

Figure 2:
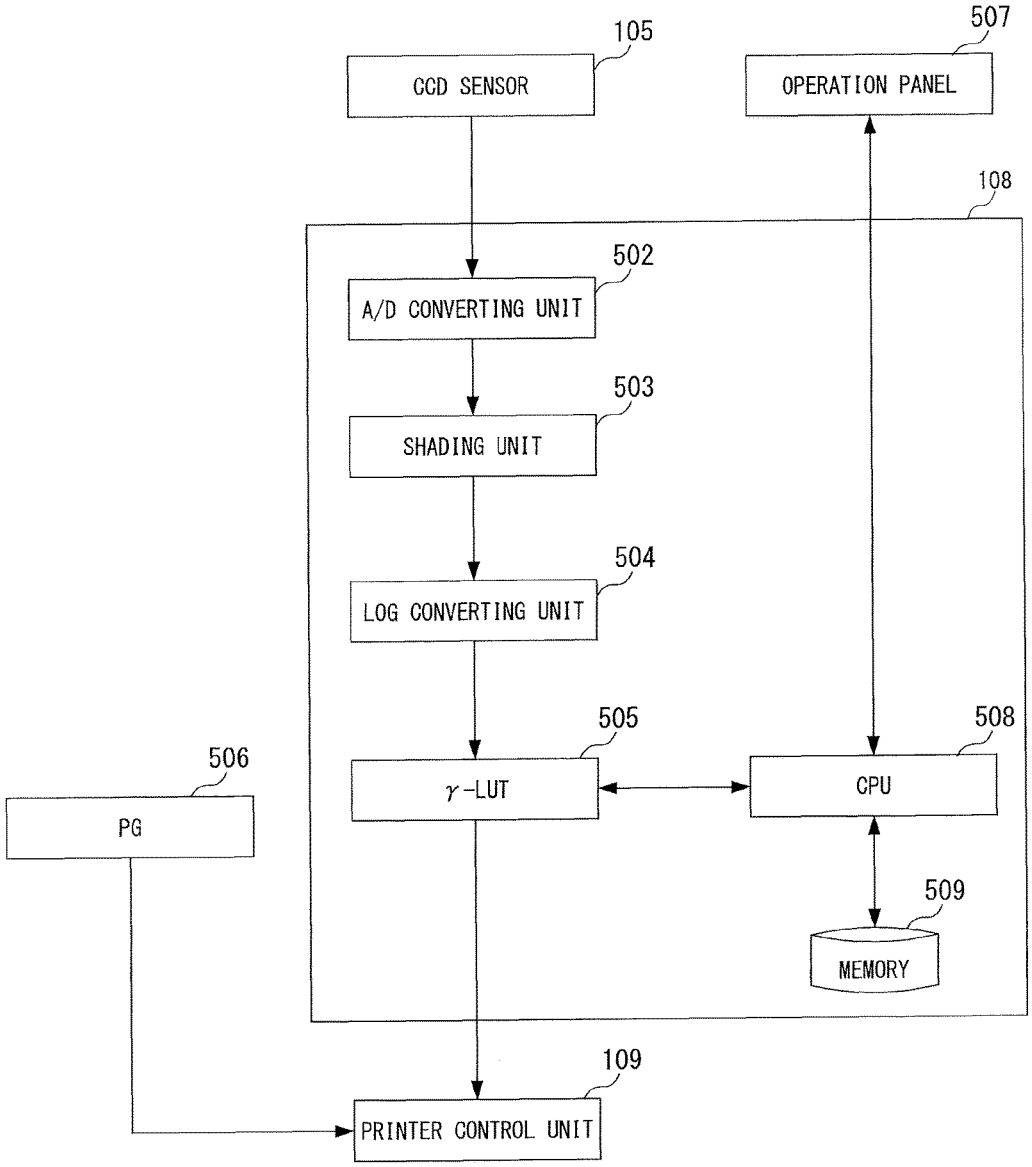
FIG. 2 is a view for illustrating the summary of image processing to be performed by a reader unit.

FIG. 2 is a view for illustrating the summary of image processing to be performed by the reader unit A.

The image processing unit 108 of the reader unit A includes an A/D converting unit 502, a shading unit 503, a LOG converting unit 504, a γ lookup table (γ-LUT) 505, the CPU 508, and the memory 509. The operation panel 507 is configured to receive the operation performed by the user to the reader unit A. The CPU 508 is configured to control the respective functional configurations of the reader unit A. The memory 509 is configured to store various items of information including the image data. The γ-LUT 505 represents a correction characteristic (gradation correction characteristic) being a reference for setting the gradation characteristic of the image forming apparatus 100 to an ideal gradation characteristic (target gradation characteristic) based on the density information obtained by reading the pattern image to be described later.

An image signal acquired via the CCD sensor 105 is input to the A/D converting unit 502 to be converted into a digital signal. The shading unit 503 is configured to receive, among the digitized signals, a luminance signal representing the luminance and to perform shading correction of correcting the "light amount unevenness" caused due to fluctuations in sensitivity of respective CCD sensor elements. With the shading correction, the measurement reproducibility of the CCD sensor 105 can be enhanced.

The luminance signal corrected by the shading unit 503 is then subjected to LOG conversion by the LOG converting unit 504. Then, the signal subjected to LOG conversion is transmitted to the γ-LUT 505. As described above, the converted image signal corrected via the γ-LUT 505 is transmitted to the printer control unit 109 configured to control the printer unit B. A pattern generator (PG) 506 is configured to form a gradation pattern image of 64 gray levels in four colors (cyan, magenta, yellow, and black).

Figure 3:
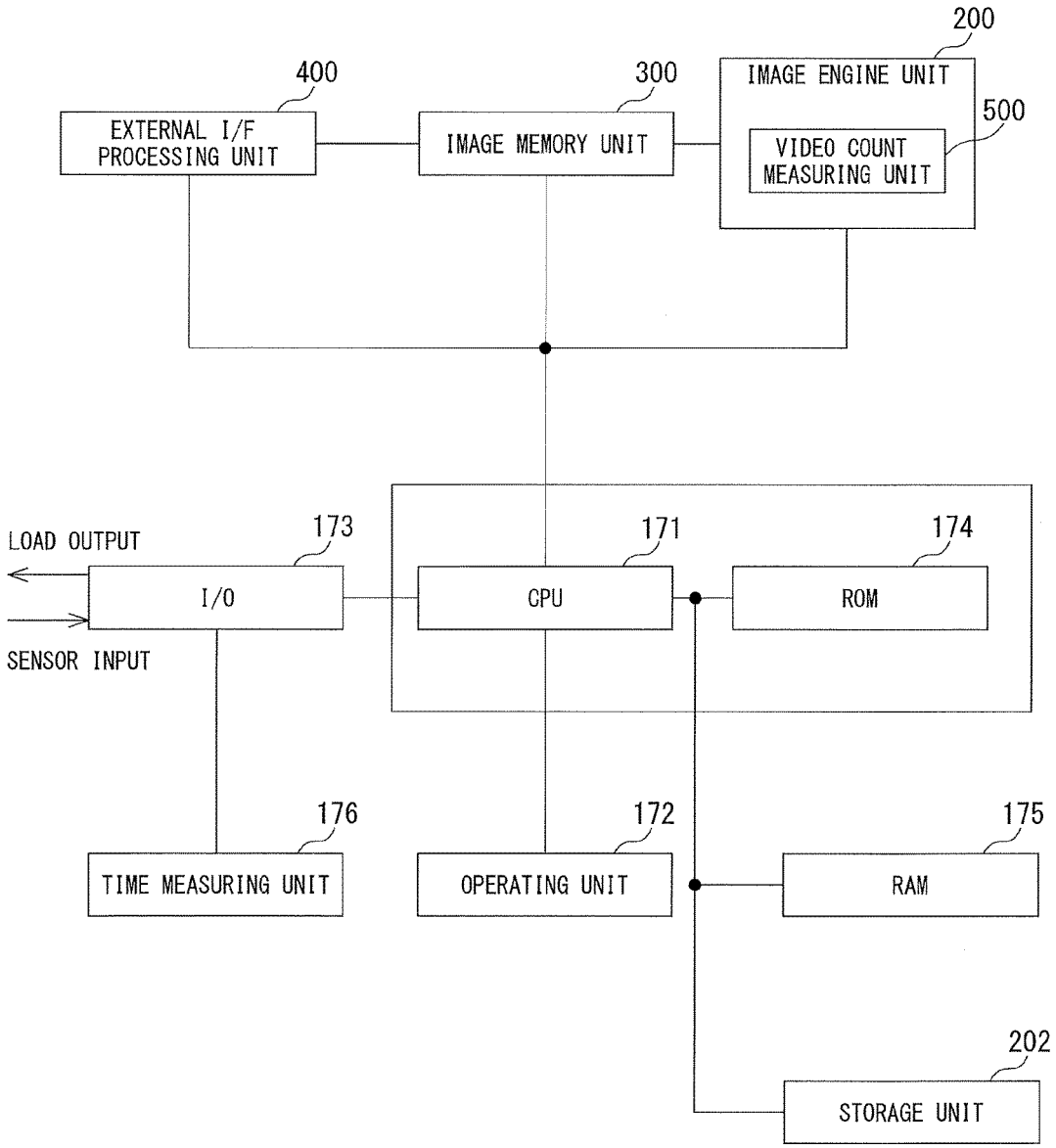
FIG. 3 is a view for illustrating the summary of image processing to be performed by a printer unit.

FIG. 3 is a view for illustrating the summary of image processing to be performed by the printer unit B.

The printer control unit 109 of the printer unit B includes a CPU 171, an operating unit 172, a ROM 174, an input/output (I/O) port 173, a RAM 175, a time measuring unit 176, an image engine unit 200, a storage unit 202, an image memory unit 300, and an external I/F processing unit 400. Further, the image engine unit 200 includes a video count measuring unit 500.

The CPU 171 is configured to read various control programs stored in the ROM 174 and the RAM 175, for example, and to control (a plurality of) driving sources of the printer unit B via the I/O port 173 in accordance with the content of the control program, to thereby control the image forming operation.

The image engine unit 200 functioning as an image forming unit is configured to control an exposure operation, which is performed by the exposure device, based on the image data received from the image memory unit 300. The image engine unit 200 includes the video count measuring unit 500.

The time measuring unit 176 is configured to measure the non-rotation time period of the developing sleeve. The measurement result of the time measuring unit 176 represents a time period that the apparatus is not performing the printing operation, that is, a duration time period of a non-activated state of the image forming apparatus 100. The measurement result is stored in the storage unit 202, for example.

The external I/F processing unit 400 is configured to mediate transmission and reception of information with various devices included in the reader unit A.

Figure 4:
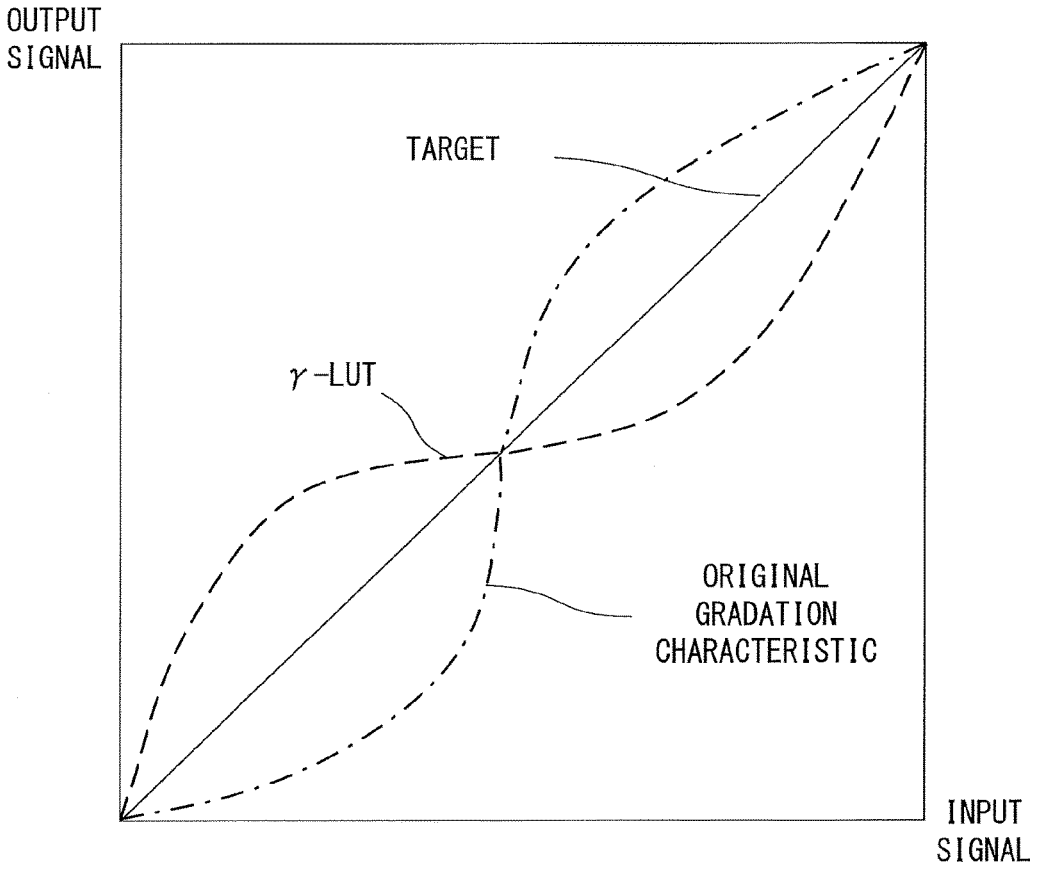
FIG. 4 is a graph for showing a characteristic of a γ-LUT.
Figure 5:
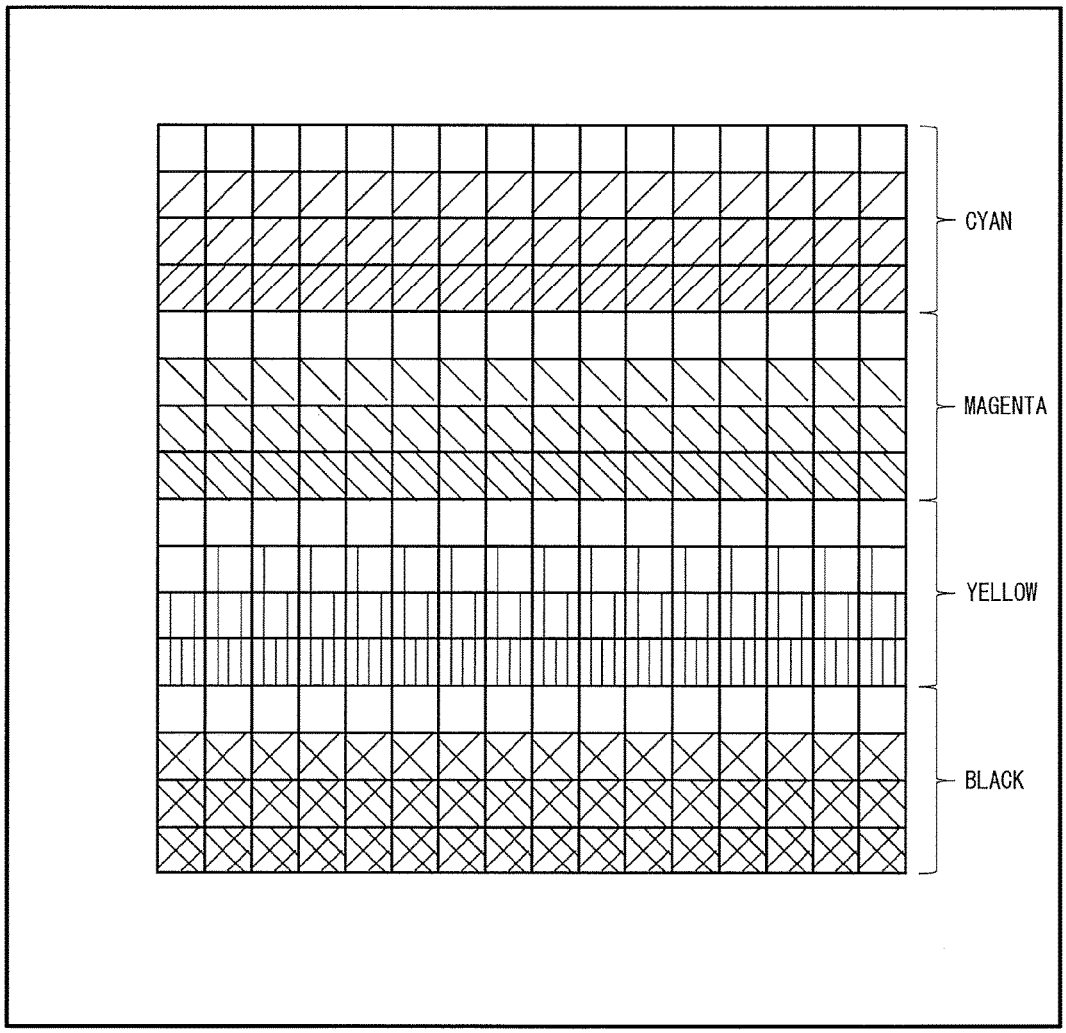
FIG. 5 is a diagram for schematically illustrating an example of a pattern image to be output by the image forming apparatus.
Figure 6:
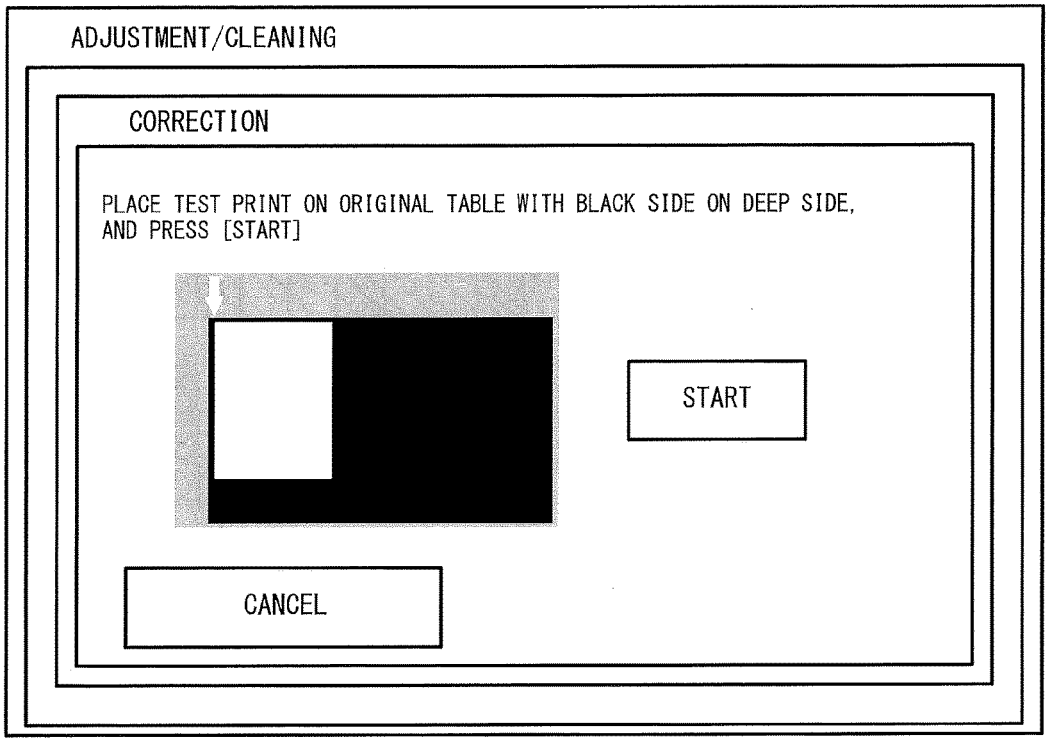
FIG. 6 is a diagram for illustrating an example of an operation screen to be displayed on an operation panel for instruction to start reading of the pattern image.

FIG. 4 is a graph for showing the characteristic of the γ-LUT. FIG. 5 is a diagram for schematically illustrating an example of the pattern image to be output by the image forming apparatus 100. FIG. 6 is a diagram for illustrating an example of an operation screen to be displayed on the operation panel 507 for instruction to start reading of the pattern image.

As shown in FIG. 4, γ-LUT (broken line) represents a gradation correction characteristic being a reference for the image forming apparatus 100 to achieve an ideal target gradation characteristic (TARGET in FIG. 4) based on the gradation characteristic (dashed-dotted line) of the image forming apparatus 100 based on the acquired density information.

Now, a process of generating the γ-LUT in the image forming apparatus 100 is described.

After receiving the instruction to start the gradation correction, the image forming apparatus 100 forms a pattern image (see FIG. 5) of 64 gray levels in four colors (cyan, magenta, yellow, and black) via the pattern generator (PG) 506 (see FIG. 3). After that, the recording material 6 having printed thereon the pattern image as illustrated in FIG. 5 is delivered outside of the apparatus.

Then, the recording material 6 having the pattern image printed thereon is placed on the original table glass 102 of the reader unit A. At this time, on the operation panel 507, an operation screen as illustrated in FIG. 6 is displayed for instruction to start reading of the pattern image. When a "reading start" button on the operation screen is selected, the reader unit A starts reading the recording material 6 having the pattern image printed thereon.

The image forming apparatus 100 reads the pattern image to acquire its density information, and then stores the acquired density information and a laser output level when the pattern image is formed in association with each other in the memory 509. The image forming apparatus 100 generates, based on the information relating to the density, which is stored in the memory 509, the γ-LUT representing the correction characteristic (gradation correction characteristic) being a reference for setting the gradation characteristic of the image forming apparatus 100 to an ideal gradation characteristic (target gradation characteristic). The generated γ-LUT is set as the γ-LUT 505. This series of control processing of the image forming apparatus 100 is referred to as "first control system".

Next, control to be performed during normal image formation, which relates to stabilization of image reproduction characteristic by the printer unit B (referred to as "second control system" in the image forming apparatus 100) is described.

In this second control system, the density of the pattern image formed on the photosensitive drum 4 is detected, and the content of the γ-LUT 505 is corrected based on the detected density information.

Figure 7:
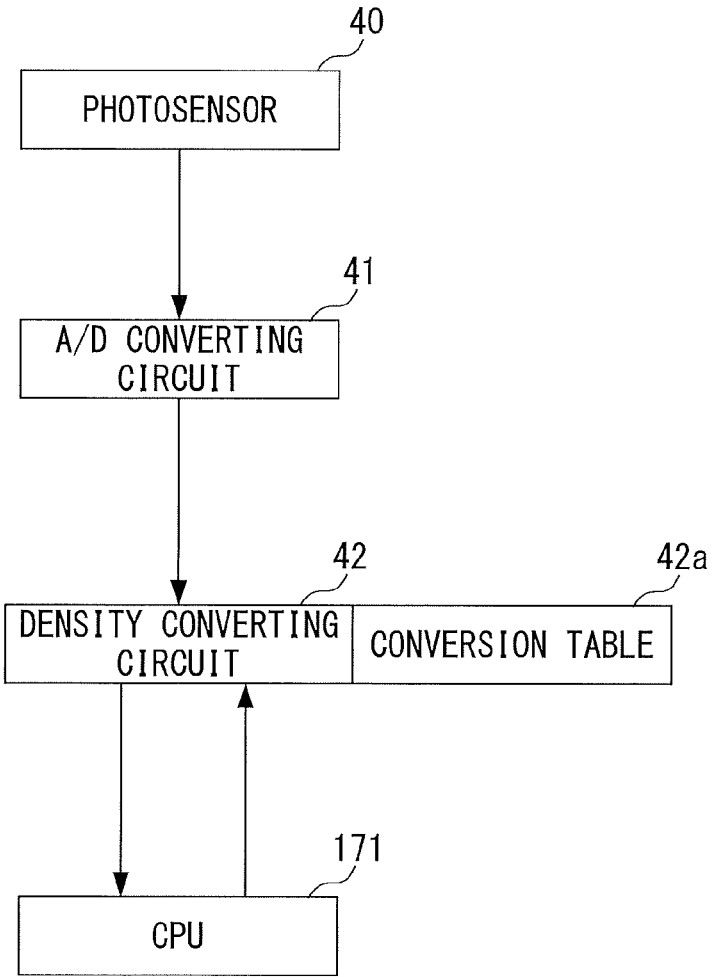
FIG. 7 is a diagram for illustrating a processing circuit configured to process a signal output from a photosensor.

FIG. 7 is a diagram for illustrating a processing circuit configured to process a signal output from the photosensor 40. In this embodiment, description is made assuming that four photosensors 40 are arranged, a pattern image is formed at a detection position of each photosensor, and the photosensor 40 detects only specular reflection light from the photosensitive drum 4.

The photosensor 40 is configured to detect the near-infrared light from the photosensitive drum 4, to thereby convert the near-infrared light into an electric signal to be output. An A/D converting circuit 41 is configured to convert the output electric signal (output voltage of 0 V to 5 V) into a digital signal of from level 0 to level 255. A density converting circuit 42 is configured to refer to a conversion table 42*a* for converting the sensor output signal into a density signal, to thereby convert the output result of the A/D converting circuit 41 into a density signal. The conversion result of the density converting circuit 42 is transmitted to the CPU 171.

Figure 8:
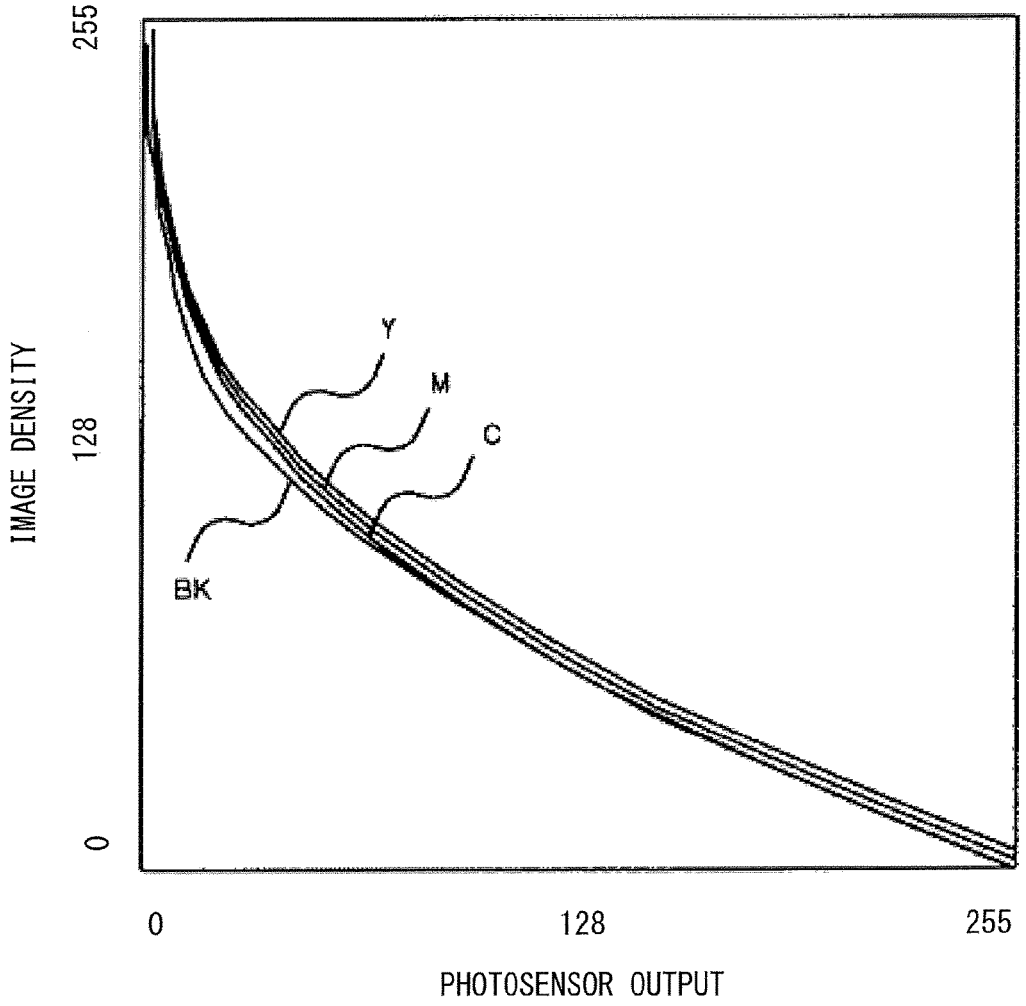
FIG. 8 is a graph for showing a relationship between an output value of the photosensor and image density.

FIG. 8 is a graph for showing the relationship between the output value of the photosensor 40 and the image density. In FIG. 8, there is exemplified a relationship between the output value of the photosensor 40 and the image density when the density on the photosensitive drum 4 is changed step by step by area coverage modulation of each color. In this case, the output of the photosensor 40 under a state in which toner is not adhering to the photosensitive drum 4 is set to 5 V, that is, level 255.

In the graph of FIG. 8, it is found that, as the area coverage rate of each toner is increased and the image density is increased (becomes darker), the output value of the photosensor 40 is decreased. Due to such a characteristic, with use of the conversion table 42*a* for converting the sensor output signal into a density signal for each color, the density signal can be read at high accuracy for all of the colors.

The second control system has an object of stably maintaining the image processing characteristic (color reproducibility) after the adjustment is achieved by the first control system, and hence the density value in a state immediately after the end of the control by the first control system is set as a target value in the second control system.

Now, an example of a processing procedure of setting a target value in the second control system is described with reference to FIG. 9.

Figure 9:
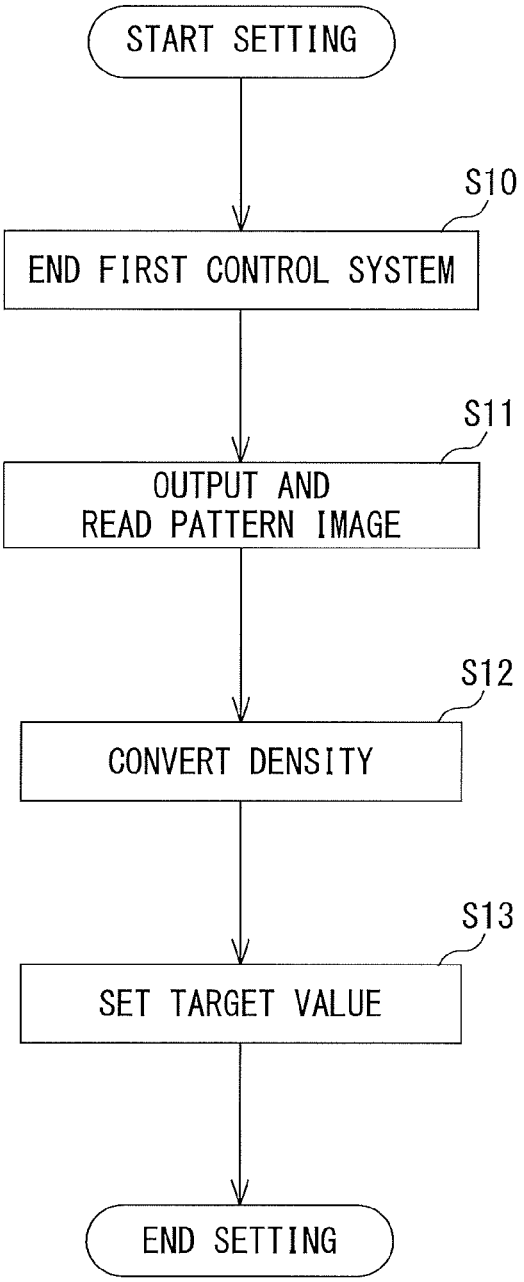
FIG. 9 is a flow chart for illustrating an example of a processing procedure of setting a target value in a second control system.

FIG. 9 is a flow chart for illustrating an example of the processing procedure of setting a target value in the second control system.

After the control by the first control system is ended (Step S10), the CPU 171 forms, on the photosensitive drum 4, a pattern image in each of four colors (cyan, magenta, yellow, and black), and reads this pattern image via the photosensor 40 (Step S11). The CPU 171 refers to the conversion table 42*a* to convert the result of reading the pattern image into a density signal (Step S12). As described above, the density of the gradation pattern image is detected based on the reading result of the photosensor 40. Further, the CPU 171 sets the density value that is based on the density signal at this time as a target value of the second control system (Step S13). The target value is stored in the storage unit 202, for example.

The CPU 171 compares the density information acquired via the photosensor 40 and the density information stored as the target value after the control by the first control system with each other, and corrects the content of the γ-LUT 505 based on the comparison result. The target value in the second control system is updated each time the control by the first control system is performed.

As described above, in the second control system, the density of the pattern image formed on the photosensitive drum 4 is detected, and based on this density, the content of the gradation correction characteristic (γ-LUT 505) determined in the first control system is corrected as needed. In other words, in the second control system, adjustment is performed to obtain the same density value as the density value (target value) of the latest gradation correction characteristic determined in the first control system.

For example, at an arbitrary timing, e.g., after the power is turned on, during the continuous image forming operation, or during post-rotation being the timing after the image forming operation is ended, the density of the pattern image formed on the photosensitive member is detected, and the content of the γ-LUT 505 is corrected as needed based on the detection result. Therefore, particularly in an image forming apparatus capable of forming a full-color image, the color reproducibility after the power is turned on can be more stably maintained.

Next, processing of suppressing a user's misperception of regarding the gradation characteristic correction as color deviation, which is one feature of the present invention, is described.

In the image forming apparatus 100, a duration time period of a state in which the image forming apparatus 100 is not performing the printing operation, that is, a duration time period of a non-activated state is referred to as an "uncontrolled time period", and the correction amount that is based on the gradation correction characteristic is adjusted depending on the length of the uncontrolled time period.

In the description of this embodiment, the uncontrolled time period is defined as a duration time period of non-rotation of the developing sleeve. The developing sleeve is not rotated under a state in which the power of the image forming apparatus is turned off. Further, the developing sleeve is not rotated in a sleep mode in which power supply to the image forming apparatus is suppressed to be smaller than a predetermined value. Further, the rotation of the developing sleeve is stopped when new image data is not transferred even after elapse of a predetermined time period from formation of all of the images included in one set of image data. The time measuring unit 176 is configured to count the elapsed time period in a state in which the power is off, the elapsed time period in the sleep mode, and the elapsed time period in a job standby state as the uncontrolled time period. Further, in the image forming apparatus 100, the gradation correction characteristic is adjusted based on a value of a correction coefficient determined based on the uncontrolled time period.

Figure 10:
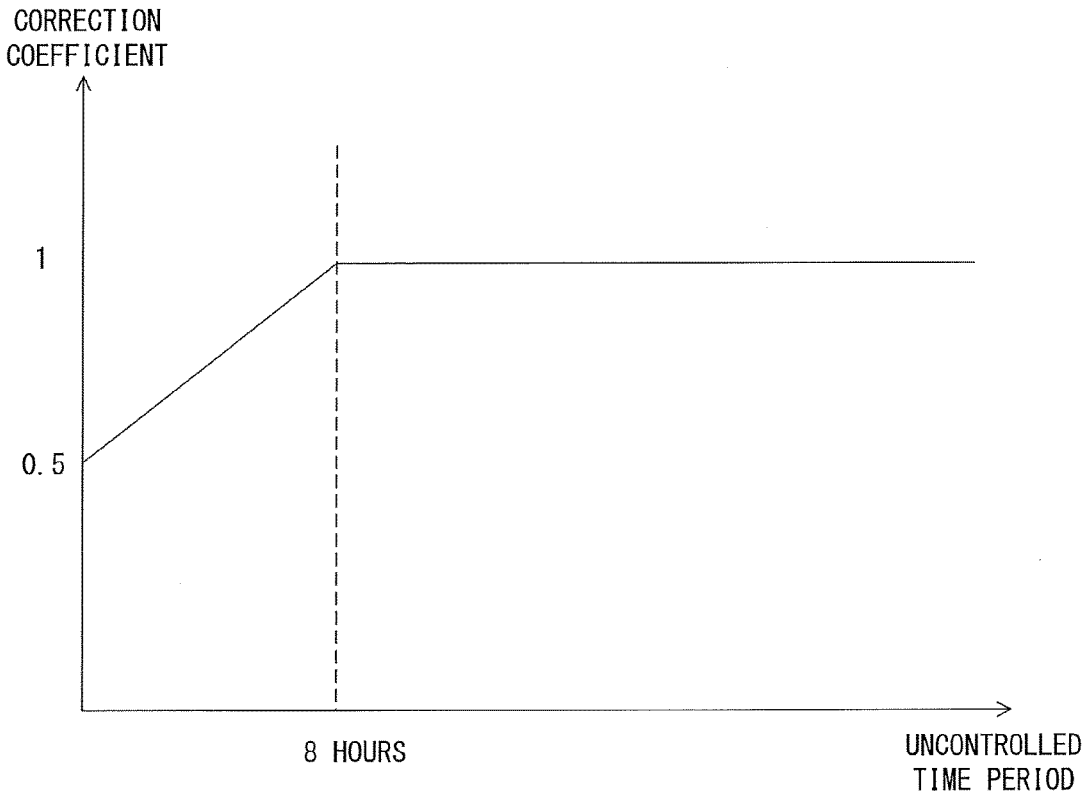
FIG. 10 is a graph for showing a relationship between a correction coefficient and an uncontrolled time period.

FIG. 10 is a graph for showing the relationship between the correction coefficient and the uncontrolled time period.

The correction coefficient is used for adjusting the target value for achieving the ideal target gradation characteristic in the image forming apparatus 100. That is, the correction coefficient is used for adjusting the correction amount for the gradation correction that is based on the content of the γ-LUT obtained in the first control system and the second control system (correction amount obtained by the control).

The value of the correction coefficient falls within a range of from 0 to 1. For example, in this embodiment, the value of the correction coefficient falls within a range of from 0.5 to 1.0. Further, the above-mentioned adjustment of the correction amount is mainly performed by the CPU 171. The image forming apparatus may include, separately from the CPU 171, an ASIC for adjusting the correction amount.

Further, in this embodiment, as shown in FIG. 10, when the uncontrolled time period is 8 hours or more, that is, when the duration time period of the non-activated state of the apparatus is a predetermined time period (for example, 8 hours) or more, the correction coefficient is set to be a constant value. For example, when a stopping time period in which the rotation of the developing sleeve is stopped is 8 hours or more, the CPU 171 sets the correction coefficient to 1.0. This reason is because, when the main body is not activated for 8 hours or more, there is considered such a situation that it is night-time in which the office operation is ended, or a user who performs printing at a very low frequency is using the apparatus. Under such a situation, it is preferred to perform correction to an ideal gradation characteristic rather than leaving the continuity of color deviation. In this case, for example, the correction coefficient is set to 1.0 such that the gradation correction is performed without changing the correction amount obtained by the control.

As described above, the correction coefficient used when the uncontrolled time period is long is set to a value for putting weight on correcting the gradation characteristic to an ideal gradation characteristic.

Meanwhile, the correction coefficient used when the uncontrolled time period is shorter than the case where the uncontrolled time period is long is required to decrease the correction amount in the gradation correction so as to avoid misperception by the user as color deviation, instead of bringing the gradation characteristic close to the ideal gradation characteristic at once. Therefore, the value of the correction coefficient is decreased. In other words, when the uncontrolled time period is short, the color difference perceivable by the user can be reduced.

The relationship between the correction coefficient and the correction amount that is based on the gradation correction characteristic is, for example, a relationship as represented by Expression (1) below.

$$\text{(Actual correction amount)}=\text{(correction coefficient)}\times\text{(correction amount obtained by control)} \quad \text{Expression (1)}$$

As described above, the image forming apparatus according to this embodiment is configured to apply a correction coefficient that is based on the uncontrolled time period of the apparatus to the correction amount that is based on the gradation correction characteristic, to thereby adjust the correction amount. For example, when the duration time period of the non-activated state of the apparatus is less than a predetermined time period (for example, less than 8 hours), the correction amount of the gradation correction is adjusted to be relatively smaller as the duration time period becomes shorter.

The description above can be translated as follows. When the correction coefficient corresponding to uncontrolled time period 1 is correction coefficient 1, the correction coefficient corresponding to uncontrolled time period 2 is correction coefficient 2, and the correction coefficient corresponding to uncontrolled time period 3 is correction coefficient 3, the following relational expressions are satisfied.

$$\text{(Uncontrolled time period 1)}<\text{(uncontrolled time period 2)}<\text{(uncontrolled time period 3)(provided that (uncontrolled time period 3)}<8\text{ hours)}$$

$$\text{(Correction coefficient 1)}<\text{(correction coefficient 2)}<\text{(correction coefficient 3)}$$

With this, the user's misperception of regarding the gradation correction as color deviation even when the gradation correction is performed can be suppressed.

In this embodiment, a case where the gradation characteristic is corrected by correcting the inside of the γ-LUT is described as an example. In addition, the gradation characteristic correction can be applied also to a control target that affects the density. Specifically, the control target may be a developing contrast potential, which is a difference between the charging potential and the developing bias, or may be laser power during image formation. By applying the correction coefficient to those control targets, the user's misperception of regarding the gradation correction as color deviation even when the gradation correction is performed can be suppressed. Further, for example, the actual correction amount may have an allowable width with respect to the correction amount obtained by the control.

Now, a second embodiment will be described. In this embodiment, there is described an image forming apparatus using environmental information in addition to the uncontrolled time period as an element for determining the correction coefficient. Specifically, the correction coefficient that is based on the uncontrolled time period is adjusted depending on whether the apparatus surrounding environment is a high-humidity environment or a low-humidity environment. Further, the environmental information is acquired via the temperature and humidity sensor.

In this embodiment, substantially like configurations as those of the first embodiment are denoted by like reference symbols, and detailed description thereof is omitted herein.

The humidity of the developer and the toner charging amount have a certain relationship, and the toner charging amount tends to be decreased as the humidity becomes higher. The reason is considered to be because charges are liable to move toward the moisture in the surrounding environment. Further, when the toner charging amount varies, the density of the image also varies along therewith. Further, it is generally said that the developer blends with the environment faster in a high-humidity environment than in a low-humidity environment. Further, for example, the high-humidity environment can be defined to have a relative humidity of 80% or more, and the low-humidity environment can be defined to have a relative humidity of 15% or less.

Therefore, as the apparatus installation environment is higher in humidity, a risk of the user's misperception of regarding the gradation characteristic correction as color deviation is increased even with a short uncontrolled time period.

Figure 11:
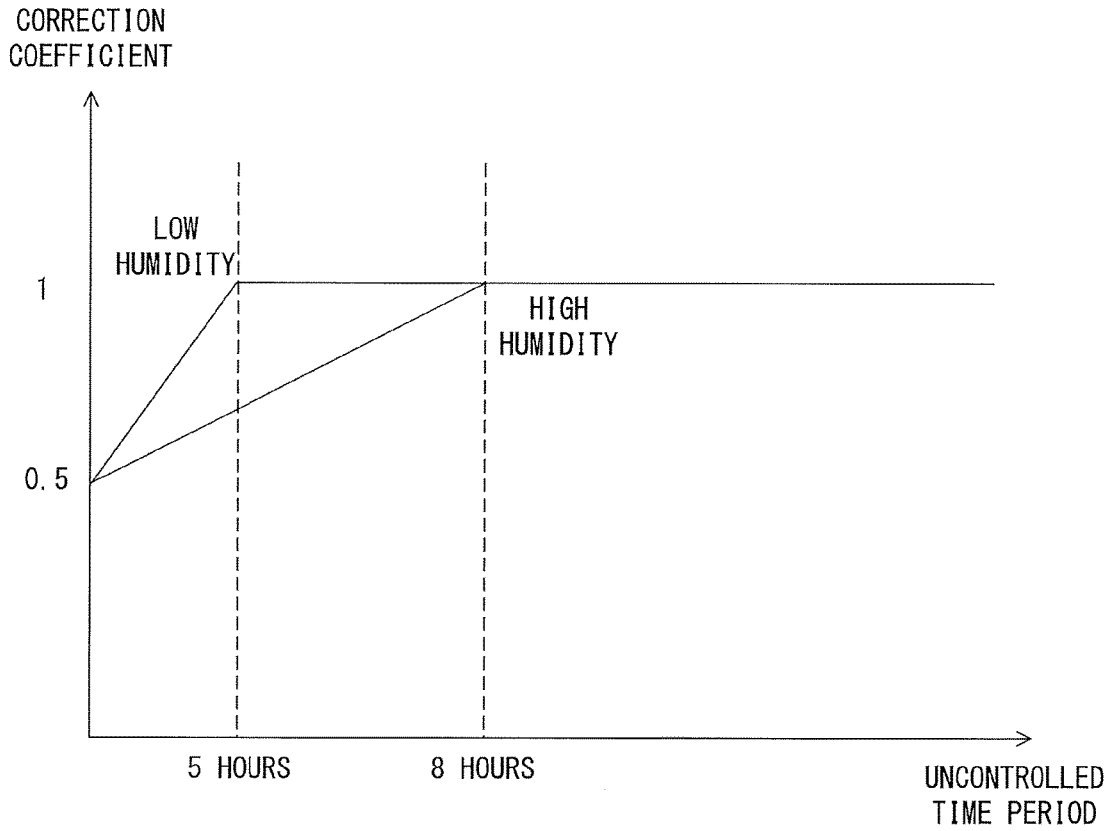
FIG. 11 is a graph for showing a relationship among a correction coefficient, an uncontrolled time period, and humidity in a second embodiment of the present invention.
Figure 12:
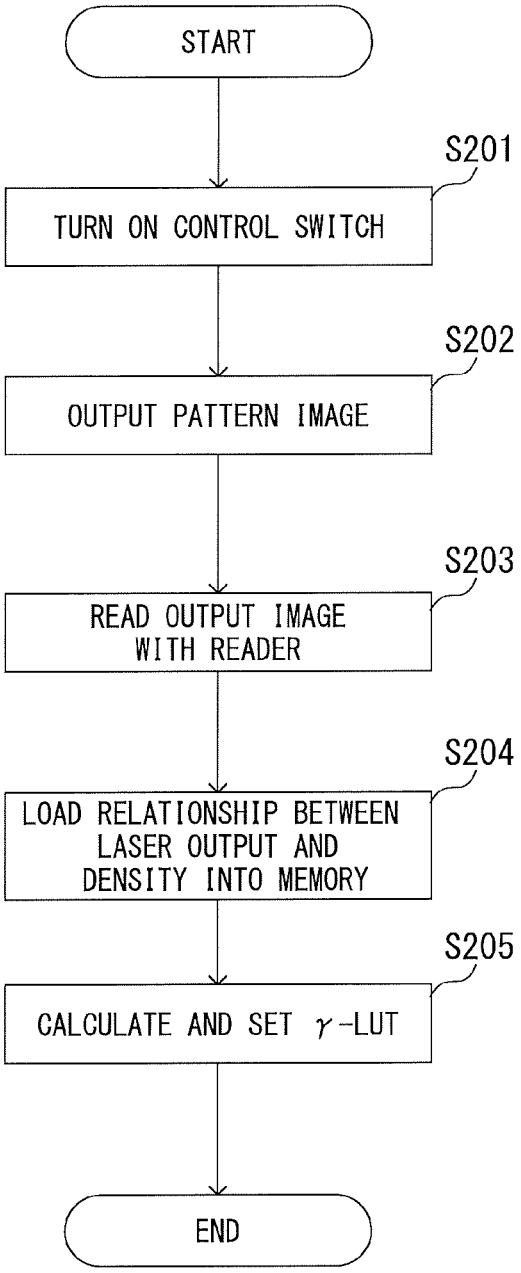
FIG. 12 is a flow chart for illustrating an example of a related-art control procedure when an image processing characteristic is adjusted.

FIG. 11 is a graph for showing the relationship among the correction coefficient, the uncontrolled time period, and the humidity in this embodiment.

In FIG. 11, there are shown transition of the value of the correction coefficient to be used in the low-humidity environment, and transition of the value of the correction coefficient to be used in the high-humidity environment in a comparable manner. In FIG. 11, it is found that the high-humidity environment has a relatively smaller slope of the correction coefficient until reaching a predetermined uncontrolled time period than that of the low-humidity environment. Further, it is found that the high-humidity environment has a relatively longer uncontrolled time period until the value of the correction coefficient reaches a constant state.

Even with the same uncontrolled time period, the value to be determined as the correction coefficient varies depending on the difference in environment. As described above, by adopting the correction coefficient depending on the apparatus installation environment, the user's misperception of regarding the gradation characteristic correction as color deviation can be more reliably suppressed.

For example, when the environment has a relative humidity of between 15% and 80%, the correction coefficient can be obtained through linear interpolation of coefficients in the high-humidity and low-humidity environments. Further, methods other than the linear interpolation may also be adopted.

Further, the image forming apparatus 100 described above has a configuration of measuring the pattern image formed on the photosensitive drum 4, but, for example, the pattern image formed on the intermediate transfer member 5 may be measured. With this configuration, the number of the photosensors 40 can be reduced. Further, the photosensor 40 may be configured to measure diffuse reflection light from the pattern image.

As described above, according to the present invention, a correction coefficient that is based on the uncontrolled time period of the image forming apparatus is applied to the correction amount that is based on the gradation correction characteristic, to thereby adjust the correction amount.

With this, the user's misperception of regarding the gradation correction as color deviation can be suppressed.

The above-described embodiments are given just for the purpose of describing the present invention more specifically, and the scope of the present invention is not limited by the embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-190844, filed Sep. 29, 2015 which is hereby incorporated by reference herein in its entirety.

What is claimed is:

1. An image forming apparatus that forms an image on a sheet, the image forming apparatus comprising:

a converting unit configured to convert image data based on a conversion condition;

an image forming unit including:

an image bearing member, a developing unit in which developer is stored, and a rotation member rotationally provided on the developing unit, wherein the image forming unit is configured to form, based on converted image data converted by the converting unit, the image on the image bearing member using the developer in the developing unit;

a sensor configured to detect a pattern image formed on the image bearing member by the image forming unit; and a controller configured to:

control the image forming unit to form the pattern image, control the sensor to detect the pattern image, and generate the conversion condition based on the detection result of the pattern image by the sensor and a stopping time period in which rotation of the rotation member is stopped.

2. The image forming apparatus according to claim 1, wherein the controller controls the image forming unit to form the pattern image after a first state in which the rotation of the rotation member is stopped is changed to a second state in which the rotation member rotates.

3. The image forming apparatus according to claim 1, further comprising a humidity sensor configured to detect humidity, wherein the controller generates the conversion condition based on the detection result of the pattern image by the sensor, the stopping time period, and the humidity detected by the humidity sensor.

4. The image forming apparatus according to claim 1, wherein the conversion condition includes a tone correction condition for correcting a gradation characteristic of an image to be formed by the image forming apparatus.

5. The image forming apparatus according to claim 1, wherein the controller determines a feedback condition corresponding to the stopping time period, and generates the conversion condition based on the detection result of the pattern image by the sensor and the feedback condition.

6. The image forming apparatus according to claim 1, wherein the controller determines a feedback condition corresponding to the stopping time period, and generates the conversion condition based on the detection result of the pattern image by the sensor and the feedback condition, wherein the controller determines a first feedback condition in a case where the stopping time period is longer than a predetermined time period, and wherein the controller determines a second feedback condition different from the first feedback condition in a case where the stopping time period is shorter than the predetermined time period.

7. The image forming apparatus according to claim 6, wherein a second ratio, which is a ratio at which a difference between a density of the pattern image detected by the sensor and a target density is corrected in a case where the conversion condition is generated based on the detection result of the pattern image and the second feedback condition, is less than a first ratio, which is a ratio at which a difference between the density of the pattern image detected by the sensor and the target density is corrected in a case where the conversion condition is generated based on the detection result of the pattern image and the first feedback condition.

8. The image forming apparatus according to claim 1, wherein the rotation member includes a developing sleeve.

* * * * *